US008122960B2

(12) United States Patent
MacDonald et al.

(10) Patent No.: US 8,122,960 B2
(45) Date of Patent: Feb. 28, 2012

(54) SPOOLABLE COILED TUBING SPEAR FOR USE IN WELLBORES AND METHODS OF USING SAME

(75) Inventors: Alasdair MacDonald, St Katherines (GB); Graeme Kelbie, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 291 days.

(21) Appl. No.: 12/583,211

(22) Filed: Aug. 17, 2009

(65) Prior Publication Data

US 2011/0036574 A1 Feb. 17, 2011

(51) Int. Cl.

| | |
|---|---|
| ***E21B 19/22*** | (2006.01) |
| ***E21B 31/12*** | (2006.01) |
| ***E21B 17/10*** | (2006.01) |

(52) U.S. Cl. ..... 166/301; 166/98; 166/385; 166/77.2; 175/325.6; 294/86.25

(58) Field of Classification Search ..... 166/98, 166/301, 385, 77.2, 85.1, 241.7; 294/86.24, 294/86.25; 175/325.6

See application file for complete search history.

(56) References Cited

U.S. PATENT DOCUMENTS

| | | | | |
|---|---|---|---|---|
| 2,806,534 | A * | 9/1957 | Potts | 166/98 |
| 3,566,965 | A * | 3/1971 | Solum | 166/241.7 |
| 6,457,519 | B1 * | 10/2002 | Buytaert | 166/241.6 |
| 2007/0012449 | A1 * | 1/2007 | Cruickshank et al. | 166/298 |
| 2008/0142229 | A1 | 6/2008 | Brisco et al. | |
| 2008/0190616 | A1 | 8/2008 | Watson | |

FOREIGN PATENT DOCUMENTS

| | | | |
|---|---|---|---|
| EP | 1025337 | B1 | 9/2003 |
| EP | 1502001 | B1 | 9/2008 |
| GB | 2146091 | A | 4/1985 |
| GB | 2155577 | A | 9/1985 |
| GB | 2178093 | A | 2/1987 |
| GB | 2242458 | A | 10/1991 |
| GB | 2283517 | A | 5/1995 |
| GB | 2287270 | A | 9/1995 |
| GB | 2303864 | A | 3/1997 |
| GB | 2349903 | B | 6/2003 |
| GB | 2349902 | B | 8/2003 |
| GB | 2426270 | A | 11/2006 |
| GB | 2440815 | A | 2/2008 |
| WO | WO 92/15767 | | 9/1992 |
| WO | WO 94/09246 | | 4/1994 |
| WO | WO 99/37877 | | 7/1999 |

(Continued)

*Primary Examiner* — Daniel P Stephenson
*Assistant Examiner* — Catherine Loikith
(74) *Attorney, Agent, or Firm* — Greenberg Traurig LLP; Anthony F. Matheny

(57) ABSTRACT

Coiled tubing spears for retrieving a section of cut coiled tubing comprises a mandrel having attachment members, e.g., spears, at upper and lower ends for facilitating connection of the upper end of the mandrel to a spooled section of coiled tubing and the lower end of the mandrel to a section of cut coiled tubing disposed in a wellbore. Coiled tubing spears comprise one or more centralizers that are releasably secured to the mandrel. The centralizer(s) facilitate lining up a lower attachment member, or spear, with the bore of the section of cut coiled tubing so that the mandrel can be secured to the cut coiled tubing for retrieval. During retrieval of the cut coiled tubing, the centralizer(s) are released from the mandrel so that the mandrel and attachment members can continue through an injector head.

25 Claims, 2 Drawing Sheets

FOREIGN PATENT DOCUMENTS

| | | | |
|---|---|---|---|
| WO | WO 02/086279 | A1 | 10/2002 |
| WO | WO 03/027434 | A1 | 4/2003 |
| WO | WO 2004/018925 | A1 | 3/2004 |
| WO | WO 2007/014006 | A1 | 2/2007 |

* cited by examiner

SPOOLABLE COILED TUBING SPEAR FOR USE IN WELLBORES AND METHODS OF USING SAME

BACKGROUND

1. Field of Invention

The invention is directed to fishing devices for retrieving coiled tubing disposed in oil and gas wells and, in particular, to spoolable coiled tubing spears for retrieving coiled tubing within the wellbores of oil and gas wells.

2. Description of Art

In certain oil and gas drilling and production operations, coiled tubing is disposed in a wellbore for carrying out the operations. As used herein, the term "wellbore" includes cased and uncased boreholes as well as risers that may be connected or in fluid communication with a subsea "Christmas tree," blowout preventer, or other component of a subsea oil or gas well. One advantage to using coiled tubing is that it can be spooled so that long lengths of tubing are more easily and efficiently delivered to and stored at the wellbore or at the off-shore floating platform or vessel from which the oil or gas operations are managed. In certain situations, the coiled tubing must be cut at or near the bottom of the wellbore, or riser. For example, in deep water oil and gas operations, a oil and gas production or drilling floating platform or vessel on the surface of the water may need to be disconnected from a subsea blowout preventer such as when a hurricane or other inclement weather is approaching. In these situations, the coiled tubing is cut at the blow-out preventer, leaving only the blowout preventer located at or near the seafloor and a short length of coiled tubing. The platform or vessel, and riser, can then either be moved as necessary, or be permitted to move with the wave-action without placing undo stresses on the coiled tubing or other structures normally connected between the platform and the blowout preventer.

After being cut, it is normally desirable to reconnect with the cut coiled tubing. To do so, however, requires the operators of the wellbore to "fish" the cut coiled tubing from the wellbore so that it can be brought to the surface of the wellbore, e.g., the floating platform or vessel, where it can be reconnected to the spooled coiled tubing. The spoolable coiled tubing spears described here achieve the function of fishing the cut coiled tubing from the wellbore.

SUMMARY OF INVENTION

Broadly, the coiled tubing spears disclosed herein include a mandrel having a spear disposed at a first or lower end, a centralizer disposed around the mandrel, and an attachment member at a second or upper end of the mandrel for securing the mandrel to a spooled length of coiled tubing. During run-in and run-out, the centralizer(s) maintain the coiled tubing in the proper alignment within the wellbore, or riser, to facilitate insertion of the spear into the bore of the cut coiled tubing as discussed in greater detail below.

The spear is designed to secure to coiled tubing left down a wellbore. In one particular embodiment, the spear comprises a grapple disposed on a spear body. The grapple is designed to be inserted into a cut end of coiled tubing for securing the grapple to an inner wall surface of the coiled tubing. As a result of this connection between the spear and the coiled tubing, retraction of the spear out of the wellbore will result in the coiled tubing also being retrieved.

In certain embodiments, the centralizer is operatively associated with a releasable member such as a collet so that the centralizer is prevented from movement along the outer wall surface of the mandrel by the releasable member. Upon reaching the surface of the wellbore, or the platform or vessel deck, the releasable member can be actuated to allow it and the centralizer to move along an outer wall surface of the mandrel so that both the collet and the centralizer slide off of the mandrel. As a result, during spooling of the coiled tubing, the coiled tubing spear, and the recovered coiled tubing, the spear and mandrel can pass through an injector head and be spooled onto a spool containing the coiled tubing.

In other particular embodiments, the coiled tubing spear comprises two spears, one at each end of the mandrel, two centralizers, and two releasable members, e.g., collets, one operatively associated with a corresponding centralizer, so that both centralizers can be released from, and slid off, the outer wall surface of the mandrel along with the releasable members.

In still other certain embodiments, the mandrel is a flex tube to facilitate the mandrel being spooled during retrieval of the cut coiled tubing.

In operation, the coiled tubing spear is attached to an end of coiled tubing disposed at the surface of the wellbore. The spear is then lowered into the wellbore by unspooling the coiled tubing from a spool. In general, before entering the wellbore, the coiled tubing passes through an injection head, through which a centralizer located on the coiled tubing spear cannot pass. Therefore, the coiled tubing spear is secured to the coiled tubing after the coiled tubing has been unspooled and passed through the injector head.

The coiled tubing spear is lowered into the wellbore until it engages the cut coiled tubing disposed within a well, or at the subsea blow-out preventer of a well. The grapple of the spear is then inserted into the bore of the cut coiled tubing so that the grapple can engage and secure the spear to an inner wall surface of the cut coiled tubing. The coiled tubing, coiled tubing spear, and, therefore, the cut coiled tubing previously disposed within the well, are retrieved by pulling, and spooling, the coiled tubing.

After the coiled tubing spear reaches the surface, the releasable member(s) are actuated, such as by either the centralizer(s) or the releasable member(s) being pulled against the injector head as the coiled tubing enters the injector head, causing the releasable member(s) to release from the mandrel or the spear body so that the releasable member(s) and the centralizer(s) can slide down the coiled tubing and the coiled tubing, mandrel, and spear(s), can pass through the injector head and be spooled onto the spool.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
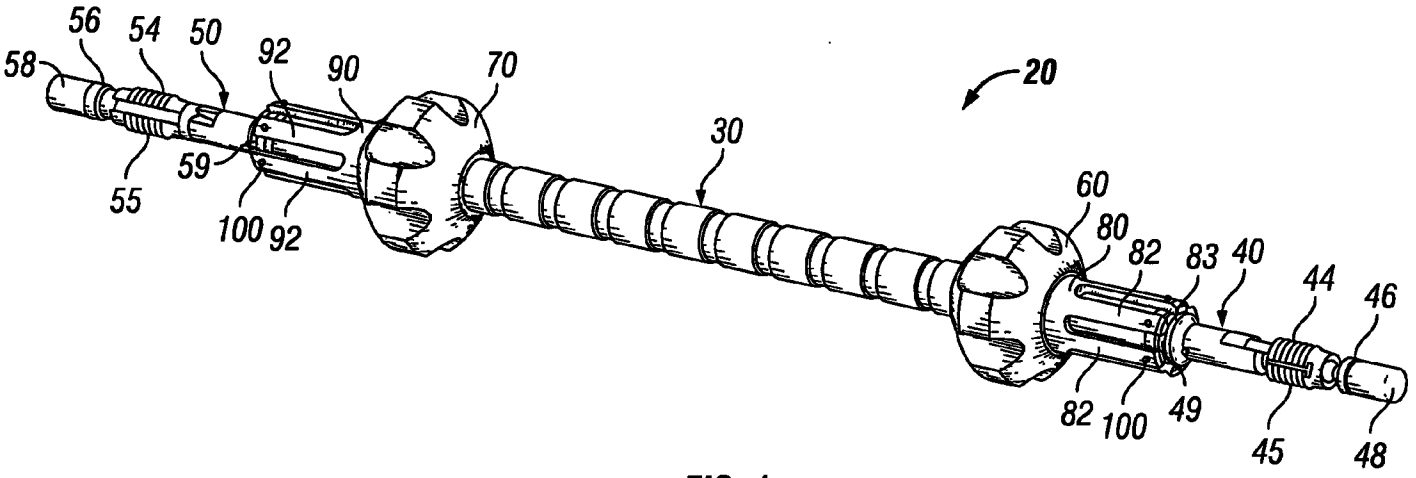
FIG. 1 is a perspective view of one particular embodiment of the coiled tubing spear disposed herein.
Figure 2:
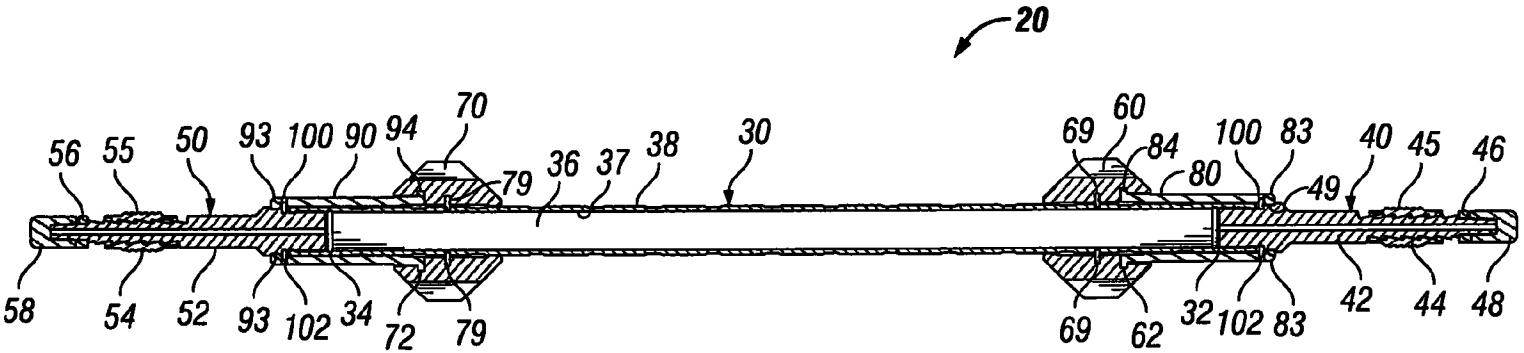
FIG. 2 is a cross-sectional view of the embodiment of the coiled tubing shown in FIG. 1.
Figure 3:
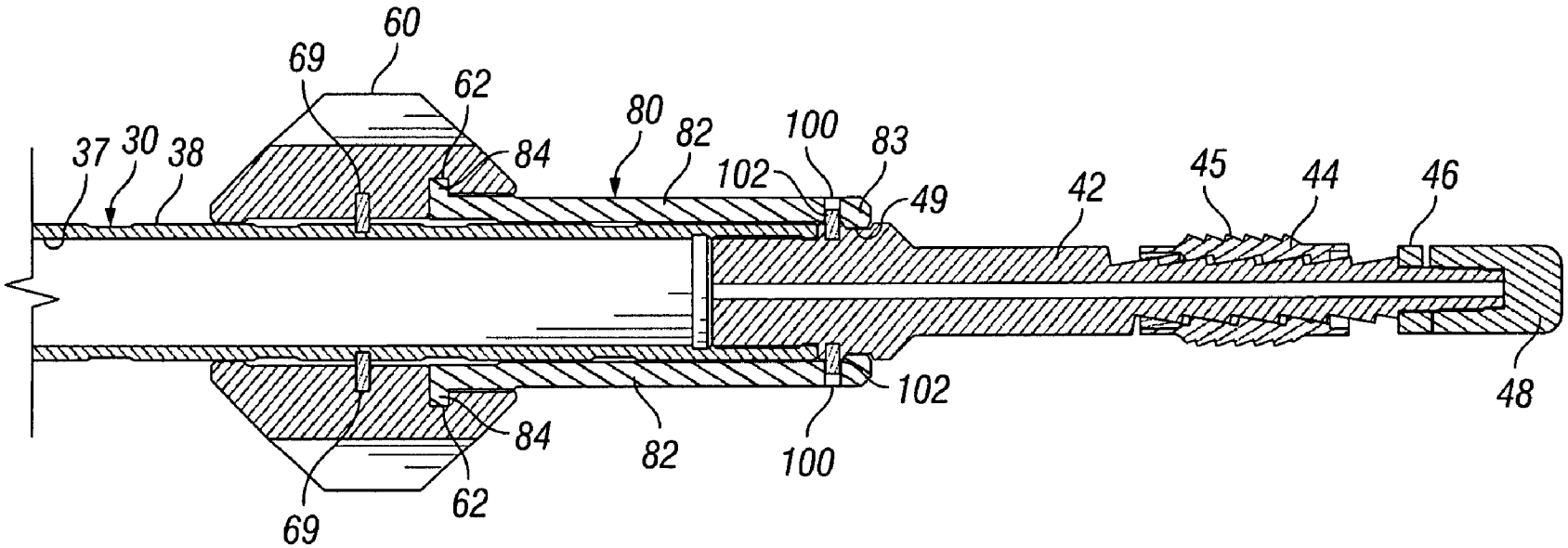
FIG. 3 is a partial cross-sectional view of the embodiment of the coiled tubing shown in FIG. 1.

Referring now to FIGS. 1-3, one specific embodiment of coiled tubing spear 20 comprises mandrel 30 having first or lower end 32, second or upper end 34, and bore 36 defined by inner wall surface 37 and outer wall surface 38. Although mandrel 30 can be formed out of any material desired or necessary to facilitate connection of a spear (discussed in greater detail below) to mandrel 30 so that cut coiled tubing can be retrieved, in one particular embodiment, mandrel 30 is a flex tube formed out of 41/40 steel or other metal or composite material have similar characteristics to 41/40 steel.

Mandrel 30 includes attached to both lower end 32 and upper end 34 an attachment member. The attachment member at lower end 32 secures the coiled tubing spear to the section of cut coiled tubing disposed in the wellbore. The attachment member at upper end 34 secures the coiled tubing spear to the section of spooled coiled tubing located at the surface of the wellbore. As used herein, the term "cut coiled tubing" refers to the section of coiled tubing disposed in the wellbore that is to be retrieved and the term "spooled coiled tubing" is the section of coiled tubing that is initially disposed on a spool located at the surface of the wellbore, e.g., on the offshore platform or on the deck of the vessel, that is unspooled and lowered down the wellbore to retrieve the cut coiled tubing. As shown in the Figures, the two attachment members are shown as spears 40, 50; however, it is to be understood that any attachment member known in the art can be used.

As shown in FIGS. 1 and 2, mandrel 30 includes spear 40 secured to lower end 32 of mandrel 30 and spear 50 secured to upper end 34. As discussed in greater detail below, in this particular embodiment, spear 50 is used to attach coiled tubing spear 20 to spooled coiled tubing located at the surface of a wellbore, or at the surface of the water. As a result, coiled tubing spear 20 can be lowered down to the section of cut coiled tubing within the wellbore or at the subsea blow-out preventer, or at any other location in which coiled tubing is used in wellbores, by unspooling the spooled coiled tubing.

In the embodiment shown in the Figures, both spears 40, 50 comprise spear bodies 42, 52, grapples 44, 54, release rings 46, 56, and retainer nut 48, 58. Grapples 44, 54, include profiles 45, 55 to facilitate attachment to an inner wall surface of a section of cut coiled tubing (not shown) when grapples 44, 54 are inserted into the bore of the section of cut coiled tubing so that the section of cut coiled tubing can be retrieved.

Centralizers 60, 70 are releasably secured to, and in some embodiments, when released, are in sliding engagement with, outer wall surface 38 of mandrel 30. Centralizers 60, 70 are each releasable secured to outer wall surface 38 by one or more releasable members, such as shear screws 69, 79. Upon retrieval of the section of cut coiled tubing from the wellbore, shear screws 69, 79 can be broken to release centralizers 60, 70 from their initial, secured position to outer wall surface 38 of mandrel 30 so that centralizers 60, 70 can be removed and mandrel 30 and spears 40, 50 can pass through an injector head located at the surface of the wellbore. In one particular embodiment, shear screws 69, 79 are broken by pulling the spooled coiled tubing through the injector head causing centralizers 60, 70, in series, to engage a surface of the injector head which applies an axial force along the length of mandrel 30. The pulling force through the injector is countered by the force being exerted on centralizers 60, 70 by the injector head causing shear screws 69, 79 to break. This allows mandrel 30 and spears 40, 50 to travel through the injector head.

In certain specific embodiments, the releasable members comprise collets 80, 90 which include collet fingers 82, 92 that are initially secured to one or both of mandrel 30 or spears 40, 50. In the embodiment of FIGS. 1-3, the tips of collet fingers 82, 92 include inner flanges 83, 93, that are disposed within recess or grooves 49, 59 of spears 40, 50, respectively (shown best in FIG. 3 with respect to spear 40). Thus, in the particular embodiment of FIGS. 1-3, collets 80, 90 are initially connected along outer wall surface 38 and to spear bodies 42, 52. Collet fingers 82, 92 can be biased outwardly such that a releasable member, such as shear screws 102 disposed in holes 100 (shown best in FIG. 3), secure collet fingers 82, 92 within grooves 49, 59 of spears 40, 50, respectively (shown best in FIG. 3 with respect to spear 40). Alternatively, collet fingers 82, 92 are not biased outwardly and shear screws 102 are absent so that after retrieving coiled tubing spear 20 with the cut portion of coiled tubing, pins or other devices (not shown) can be inserted into holes 100 to force each collet finger 82, 92 outwardly to release collets 80, 90 from mandrel 30 and/or spears 40, 50.

Centralizers 60, 70 are operatively associated with collets 80, 90 so that sliding movement of collets 80, 90 along outer wall surface 38 causes sliding movement of centralizers 60, 70 along outer wall surface 38; and so that no sliding movement of collets 80, 90 along outer wall surface 38 prevents sliding movement of centralizers 60, 70 along outer wall surface 38. In the embodiment shown in FIGS. 1-3, collet outer flanges 84, 94 of collets 80, 90, respectively, are disposed at a first end of collets 80, 90 and within centralizer recess or grooves 62, 72 of centralizers 60, 70, respectively, so that centralizers 60, 70 are operatively associated with collets 80, 90. These features are shown best in FIG. 3 with respect to centralizer 60 and collet 80.

When it is desired to release collets 80, 90, and centralizers 60, 70 from mandrel 30 or spear bodies 42, 52, pressure can be applied axially along the length of collets 80, 90 to break shear screws 102 (and, if present, shear screws 69, 79), thereby permitting collet fingers 82, 92 to radially expand and, therefore, release collets 80, 90 and centralizers 60, 70 so that they can slide along outer wall surface 38 and ultimately off of coiled tubing spear 20. In one particular embodiment, the pressure applied axially along the length of mandrel 30 is due to either centralizers 60, 70 or collets 80, 90 being forced into a surface disposed on an injector head so that mandrel 30 and spears 40, 50 can continue to travel through the injector head while centralizers 60, 70 and collets 80, 90 are slide down the section of cut coiled tubing and ultimately removed.

Alternatively, as discussed above, shear screws 102 may be absent so that a pin or other device is inserted into holes 100 to force collet fingers 82, 92 away from outer wall surface 38 of mandrel 30, grooves 49, 59, and/or spear bodies 42, 52. In so doing, collets 80, 90 are free to move, thereby freeing centralizers 60, 70 to move and ultimately be removed from coiled tubing spear 20 in the same manner as described above.

It is to be understood that the invention is not limited to the exact details of construction, operation, exact materials, or embodiments shown and described, as modifications and equivalents will be apparent to one skilled in the art. For example, spear 40 does not have to be identical in construction to spear 50. Spears 40, 50 may be any attachment member known in the art for securing the coiled tubing spear to the section of cut coiled tubing and spooled coiled tubing, respectively. Further, the coiled tubing spear can include only one centralizer, and, therefore, only one releasable member. Additionally, the collet(s) can be replaced by an other release member that is capable of releasing the centralizer(s) so the centralizer(s) can slide along the outer wall surface of the mandrel. Moreover, the collet(s) can be secured solely to the outer wall surface of the mandrel instead of as shown in FIGS. 1-3 as being also connected to the spear bodies. In addition, the grooves or recesses in the spear bodies are not required and release members other than shear screws can be used to maintain the collet fingers in connection with the mandrel or spear body. Moreover, the releasable member may be secured to either the mandrel, the spear body, or both the mandrel and the spear body. Further, the releasable member may be secured through any method or device known in the art. And, the collet(s) and may be operatively associated with the centralizer(s) through any method or device known in the art. Similarly, the collet(s) may be secured to the mandrel or spears through any method or device known in the art. Accordingly, the invention is therefore to be limited only by the scope of the appended claims.

What is claimed is:

1. A coiled tubing spear for retrieving a section of cut coiled tubing from a wellbore, the coiled tubing spear comprising:

a mandrel having an upper end, a lower end, and an outer wall surface of the mandrel;

a first centralizer releasably secured to the outer wall surface of the mandrel by a first releasable member operatively associated with the first centralizer, the first releasable member comprising a shear screw;

a first spear disposed at the lower end of the mandrel, the first spear comprising a first grapple for securing the first grapple to an inner wall surface of the section of cut coiled tubing disposed in the wellbore; and an attachment member disposed at the upper end of the mandrel to facilitate connection of the mandrel to a section of spooled coiled tubing.

2. The coiled tubing spear of claim 1, further comprising a second centralizer releasably secured to the outer wall surface of the mandrel.

3. The coiled tubing spear of claim 2, wherein the attachment member is a second spear, the second spear comprising a second grapple for securing the second grapple to an inner wall surface of a section of coiled tubing.

4. The coiled tubing spear of claim 1, wherein the mandrel comprises a flex tube.

5. A coiled tubing spear for retrieving a section of cut coiled tubing from a wellbore, the coiled tubing spear comprising:

a mandrel having an upper end, a lower end, and an outer wall surface of the mandrel;

a first centralizer disposed along the outer wall surface of the mandrel;

a first releasable member releasably secured to the outer wall surface of the mandrel and operatively associated with the first centralizer so that actuation of the first releasable member to a first released position releases the first releasable member and the first centralizer from the outer wall surface of the mandrel;

a first spear disposed at the lower end of the mandrel, the first spear comprising a first grapple for securing the first grapple to an inner wall surface of the section of cut coiled tubing disposed in the wellbore; and an attachment member disposed at the upper end of the mandrel to facilitate connection of the mandrel to a section of spooled coiled tubing.

6. The coiled tubing spear of claim 5, wherein the first releasable member comprises an inner flange disposed at a first end of the first releasable member, the first spear comprises a spear groove disposed on an outer wall surface of the first spear, and the first releasable member is initially secured to the outer wall surface of the mandrel by the inner flange being disposed within the spear groove.

7. The coiled tubing spear of claim 5, wherein the first centralizer comprises a centralizer groove and the first centralizer is operatively associated with the first releasable member by an outer flange disposed at an end of the first releasable member, the outer flange being disposed within the centralizer groove.

8. The coiled tubing spear of claim 5, wherein the first releasable member is initially secured to the outer wall surface of the mandrel by at least one shear screw.

9. The coiled tubing spear of claim 5, wherein the first releasable member is a first collet.

10. The coiled tubing spear of claim 9, wherein the first collet comprises a plurality of collet fingers, each collet finger comprising an inner flange disposed at corresponding tips of each of the collet fingers, the first spear comprises one or more grooves disposed on an outer wall surface of the spear for receiving each of the inner flanges of the collet fingers, and the first collet is initially secured to the outer wall surface of the mandrel by each of the inner flanges of the collet fingers being disposed within the one or more grooves.

11. The coiled tubing spear of claim 10, wherein the first centralizer comprises a centralizer groove and the first centralizer is operatively associated with the first collet by an outer flange disposed at an end of the first collet, the outer flange being disposed within the centralizer groove.

12. The coiled tubing spear of claim 11, wherein the first releasable member is initially secured to the outer wall surface of the mandrel by at least one shear screw.

13. The coiled tubing spear of claim 5, further comprising a second centralizer disposed along the outer wall surface of the mandrel;

a second releasable member releasably secured to the outer wall surface of the mandrel and operatively associated with the second centralizer so that actuation of the releasable member to a second released position releases the second releasable member and the second centralizer from the outer wall surface of the mandrel.

14. The coiled tubing spear of claim 13, wherein the attachment member is a second spear, the second spear comprising a second grapple for securing the second grapple to an inner wall surface of a section of coiled tubing.

15. The coiled tubing spear of claim 14, wherein the first releasable member and the second releasable members are collets initially secured to the mandrel by at least one shear screw.

16. The coiled tubing spear of claim 5, wherein the first releasable member comprises a shear screw.

17. The coiled tubing spear of claim 5, wherein the mandrel comprises a flex tube.

18. A method of retrieving a section of cut coiled tubing from a wellbore, the method comprising the steps of:

(a) guiding a section of spooled coiled tubing through an injector head located at a surface of the wellbore;

(b) securing a coiled tubing spear to the section of spooled coiled tubing, the coiled tubing spear comprising a mandrel having an upper end, a lower end, and an outer wall surface of the mandrel;

a centralizer releasably secured with the outer wall surface of the mandrel;

a spear disposed at the lower end of the mandrel, the spear comprising a grapple for securing the grapple to an inner wall surface of the section of cut coiled tubing disposed in the wellbore;

(c) running the coiled tubing spear into the wellbore by unspooling the spooled coiled tubing;

(d) inserting the grapple into a bore of the section of cut coiled tubing disposed in the wellbore causing the spear to be connected to the cut coiled tubing;

(e) retrieving the section of cut coiled tubing by spooling the spooled coiled tubing;

(f) upon reaching a surface of the wellbore, releasing the centralizer from the outer wall surface of the mandrel; and (g) continuing to spool the section of spooled coiled tubing, the mandrel, the spear, and the section of cut coiled tubing through the injector head.

19. The method of claim 18, wherein the centralizer is released from the outer wall surface of the mandrel by pulling the centralizer into a surface disposed on the injector head during spooling of the spooled coiled tubing.

20. A coiled tubing spear for retrieving a section of cut coiled tubing from a wellbore, the coiled tubing spear comprising:

a mandrel having an upper end, a lower end, and an outer wall surface of the mandrel;

a first centralizer releasably secured to the outer wall surface of the mandrel;

a first spear disposed at the lower end of the mandrel, the first spear comprising a first grapple for securing the first grapple to an inner wall surface of the section of cut coiled tubing disposed in the wellbore;

a second centralizer releasably secured to the outer wall surface of the mandrel; and an attachment member disposed at the upper end of the mandrel to facilitate connection of the mandrel to a section of spooled coiled tubing, the attachment member having a second spear, the second spear comprising a second grapple for securing the second grapple to an inner wall surface of a section of coiled tubing.

21. The coiled tubing spear of claim 20, wherein the first centralizer is releasably secured to the outer wall surface of the mandrel by a first releasable member, the first releasable member comprising an inner flange disposed at a first end of the first releasable member, the first spear comprises a spear groove disposed on an outer wall surface of the first spear, and the first releasable member is initially secured to the outer wall surface of the mandrel by the inner flange being disposed within the spear groove.

22. The coiled tubing spear of claim 20, wherein the first centralizer comprises a centralizer groove and the first centralizer is operatively associated with a first releasable member by an outer flange disposed at an end of the first releasable member, the outer flange being disposed within the centralizer groove.

23. The coiled tubing spear of claim 20, wherein the first centralizer is releasably secured to the outer wall surface of the mandrel by a first releasable member, the first releasable member comprising a first collet.

24. The coiled tubing spear of claim 23, wherein the first collet comprises a plurality of collet fingers, each collet finger comprising an inner flange disposed at corresponding tips of each of the collet fingers, the first spear comprises one or more grooves disposed on an outer wall surface of the spear for receiving each of the inner flanges of the collet fingers, and the first collet is initially secured to the outer wall surface of the mandrel by each of the inner flanges of the collet fingers being disposed within the one or more grooves.

25. The coiled tubing spear of claim 24, wherein the first centralizer comprises a centralizer groove and the first centralizer is operatively associated with the first collet by an outer flange disposed at an end of the first collet, the outer flange being disposed within the centralizer groove.

* * * * *